United States Patent [19]

Christ et al.

[11] 3,942,728

[45] Mar. 9, 1976

[54] STOCK PULPER

[75] Inventors: Alfred Christ, Zurich, Switzerland; Wolfgang Heinbockel; Albrecht Kahmann, both of Weingarten, Germany; Karl Muller, Ringgenweiler, Germany; Manfred Kohrs, Ravensburg, Germany

[73] Assignee: Escher Wyss GmbH, Ravensburg, Germany

[22] Filed: Aug. 19, 1974

[21] Appl. No.: 498,720

[30] Foreign Application Priority Data

Aug. 27, 1973 Switzerland ..... 12229/73

[52] U.S. Cl. ..... 241/46.17; 209/211

[51] Int. Cl.[2] ..... B02C 23/36

[58] Field of Search ..... 241/46.11, 46.17, 73; 209/211, 434, 464, 467, 473, 494, 501

[56] References Cited

UNITED STATES PATENTS

| | | | |
|---|---|---|---|
| 3,722,832 | 3/1973 | Seifert | 241/46.17 |
| 3,859,206 | 1/1975 | Baggaley | 209/211 X |

FOREIGN PATENTS OR APPLICATIONS

| | | | |
|---|---|---|---|
| 400,230 | 12/1966 | Australia | 241/46.17 |
| 1,101,918 | 3/1961 | Germany | 241/46.11 |

*Primary Examiner*—Granville Y. Custer, Jr.
*Attorney, Agent, or Firm*—Kenyon & Kenyon Reilly Carr & Chapin

[57] ABSTRACT

The container for the stock suspension is made as a body of revolution with a conical circumferential wall and a conical end wall which defines an acute angle with the circumferential wall to facilitate separation of materials. A compartment is formed in the circumferential wall near the end wall. This compartment is of increasing radial thickness in the direction of rotation of the rotor and terminates at the location of an outlet for heavy impurities.

8 Claims, 2 Drawing Figures

STOCK PULPER

Figure 1:
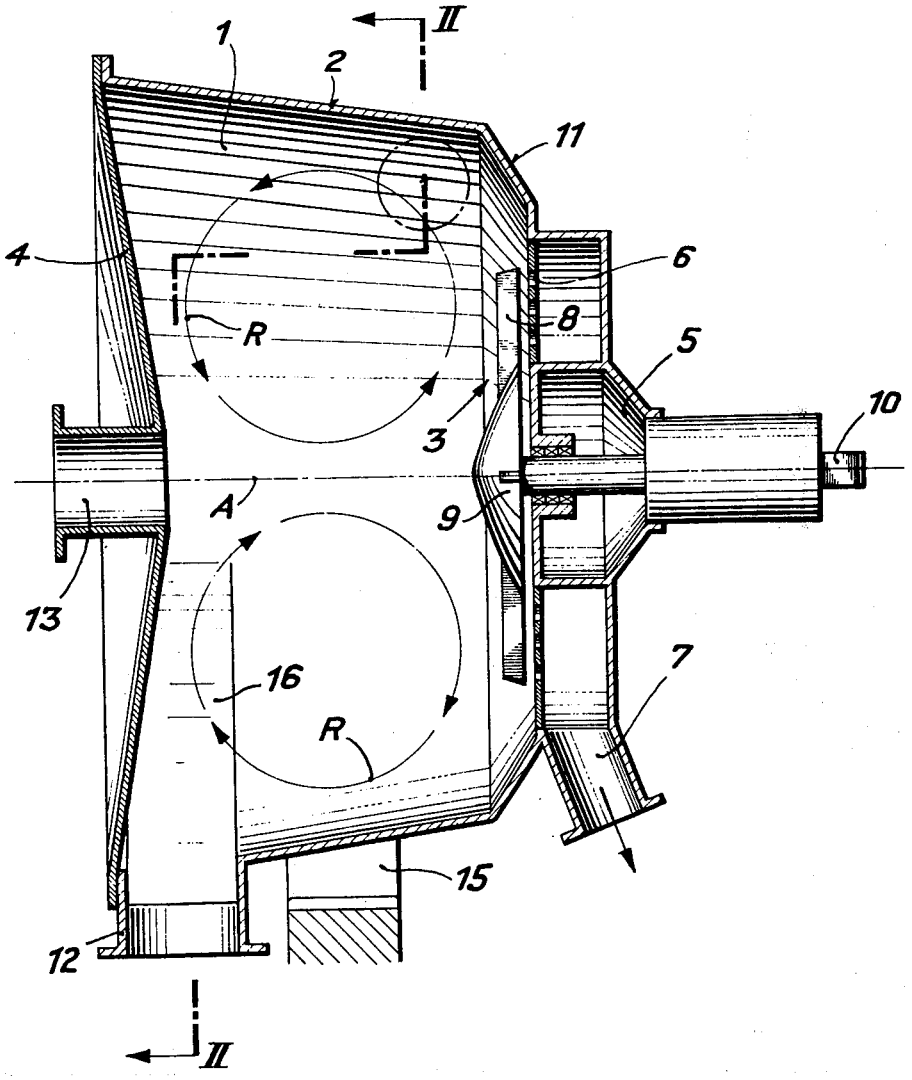

This invention relates to a stock pulper for pulping and sorting waste paper.

Stock pulpers have been known in which a container for accommodating a stock suspension is formed as a body of rotation with a circumferential wall, a front wall and an end wall. Generally, a rotor is positioned axially on the front wall and in front of a screen or sieve to which is connected a discharge pipe for the discharge of good stock. In addition, various openings have been formed in the container for removing impurities. For example, it has been known to provide a container with an outlet opening in the end wall opposite to the rotor and substantially axially of the container for discharging impurities of low specific gravity while a discharge opening is arranged in the circumferential wall for the removal of heavy impurities.

Stock pulpers of this type serve for pulping and sorting waste paper which is used in the manufacture of paper. Usually, the good stock which is discharged can be used directly for the manufacture of new paper. The light weight impurities, as for example synthetic plastic foils, are removed through the outlet opening disposed axially of the container. The heavy impurities, as for example metallic parts, are removed through the outlet opening formed in the circumferential wall.

Generally, these known stock pulpers have had a limited sorting action which has now been found to be due in part to the particular construction used in the fabrication of the container. In addition, the container of these stock pulpers have been subjected to a relatively great amount of wear caused particularly under the influence of the heavy impurities.

Accordingly, it is an object of this invention to improve the sorting action of stock pulpers.

It is another object of the invention to reduce the wear on the stock suspension container of a stock pulper.

Briefly, the invention provides a stock pulper for pulping and sorting waste paper with a container for receiving a stock suspension which has a conical circumferential wall. The container also has an end wall with an outlet opening for impurities and the circumferential wall has a diameter which increases in the direction of the end wall to meet with the end wall and form an acute angle. An outlet opening for heavy impurities is also disposed in the portion of the circumferential wall which adjoins the end wall.

In order to circulate the suspension within the container, a rotor or other suitable stirrer means is mounted adjacent a front wall. The front wall is also provided with a screen or sieve for discharging good stock.

The conical circumferential wall of the container assists a movement of heavy impurities in a delivered stock suspension along the wall as far as the region of the outlet opening, where the impurities can be separated out. The acute angle existing between the end wall and the circumferential wall allows the formation of a region in which a slower circulatory flow can occur. This facilitates the separating out of the heavy substances. As a consequence, the heavy substances, which are mainly responsible for the wear on the circumferential wall, are separated out more quickly and more efficiently than hitherto.

The end wall can advantageously be conical, the apex of its cone being directed into the interior of the container. This measure not only improves separation of the heavy materials, but also facilitates separation of the light materials from the center of the vortex formed in the container.

In order to further enhance the removal of heavy impurities, a compartment is provided in the circumferential wall which extends over a part of the container. This compartment is of a radial depth which, considered in the direction of rotation of the rotor, increases towards the end of the compartment; the outlet opening being situated at that position in the compartment which has the maximum depth. In this way the heavy materials are prevented from being moved over a relatively long period on the circumference of the container.

Furthermore, the outlet opening can advantageously be formed by a substantially radially extending discharge pipe. In addition, the end wall of the compartment has a projection directed opposite to the direction of rotation of the rotor. The highest point or apex of the projection is disposed radially outside the plane of the surface of the circumferential wall of the container. The projection functions to cause an advantageous splitting up of the flow in the circumferential direction of the container and the formation of an eddy flow in the compartment so that parts which are in the compartment are unable to return into the container. This also has a favorable influence on the wear of the container and the separating effect of the stock pulper.

The axis of the container can advantageously be arranged horizontally and the compartment can be situated at the lowest point of the container. This assists the separation effect of the stock pulper, particularly with respect to the heavy materials.

Figure 2:
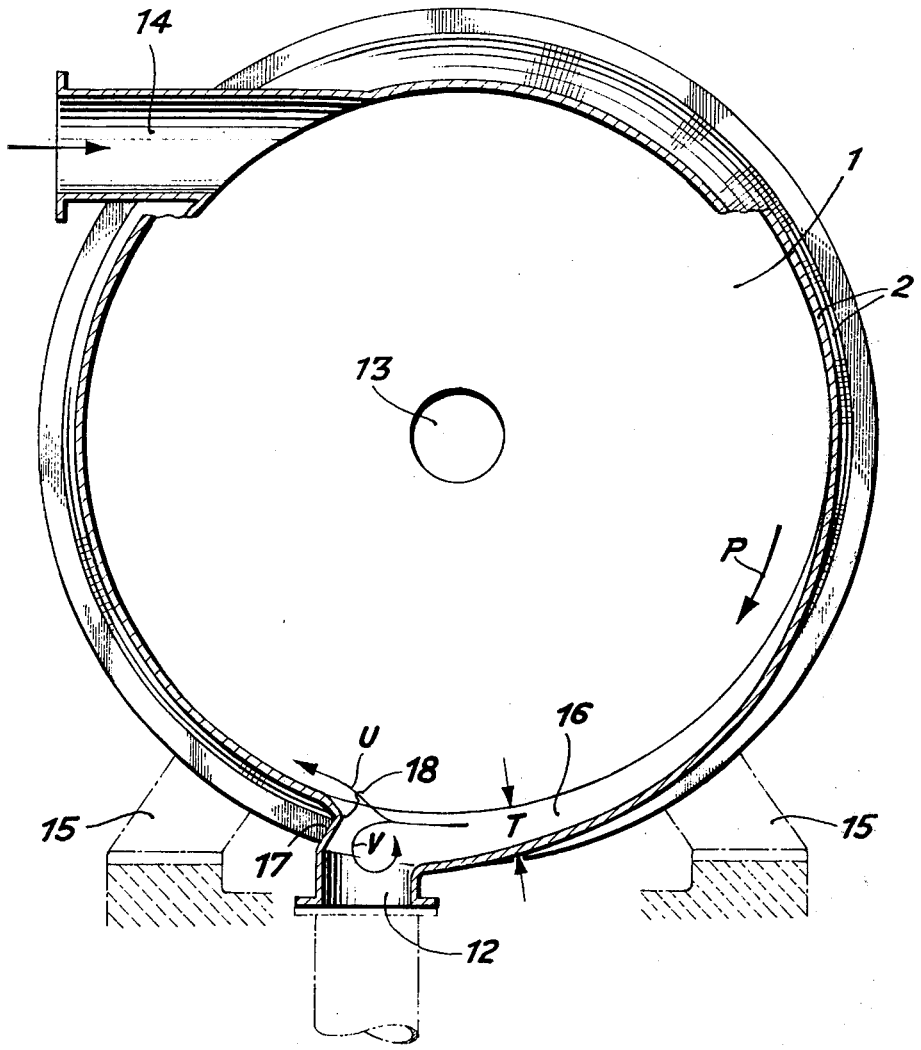

These and other objects and advantages of the invention will become more apparent from the following detailed description and appended claims taken in conjunction with the accompanying drawings in which:

FIG. 1 illustrates an axial sectional view of a stock pulper according to the invention; and FIG. 2 illustrates a view taken on line II—II of FIG. 1.

Referring to FIGS. 1 and 2, a stock pulper for pulping and sorting waste paper has a container 1 in the form of a body of revolution with a conical circumferential wall 2, a front wall 3 and a conical end wall 4. As shown, the circumferential wall 2 extends from the front wall 3 on an increasing diameter to the end wall 4. The front wall 3 is formed by the front wall of a bearing housing 5 and has a sieve or screen 6 therein forming a part of the wall 3 through which stock can be discharged. A discharge means in the form of a pipe 7 is connected to the front wall 3 for discharging the stock passed through the screen 6. In addition, a rotor 9 is rotatably mounted within the container 1 with blades 8 at a small spacing from the front of the screen 6. The rotor 9 is disposed axially of the container 1 and is driven through a shaft 10 by a suitable drive means (not shown).

The circumferential wall 2 is formed with a section 11 adjacent the front wall 3 which has a larger cone angle than the remainder of the circumferential wall 2. This section 11, as shown, surrounds the blades 8 of the rotor 9.

The conical end wall 4 has an apex which is directed into the interior of the container 1 for purposes as explained below.

In order to discharge impurities from a suspension within the container 1, the circumferential wall 2 is provided with an outlet opening in the form of a discharge pipe 12 for heavy weight impurities. The pipe 12 is located in the part of the wall 2 adjacent the end wall 4. Also, the end wall 4 is provided with an outlet opening in the form of a discharge pipe 13 for removing light weight impurities, i.e. impurities of low specific gravity such as synthetic plastic parts and foils. This pipe 13 is located on the axis of the container 1 and is opposite the rotor 9.

Referring to FIG. 2, the container 1 has an inlet means in the form of a pipe 14 in the circumferential wall 2 for waste paper. In addition, the container has supports 15 for setting on in a horizontal disposition on a ground surface.

Referring to FIGS. 1 and 2, a compartment 16 is formed within the container 1 and extends over a part of the circumference of the circumferential wall 2 to communicate with the outlet opening formed by the pipe 12. The compartment serves to enhance the extraction of heavy impurities from the suspension and is of a radial depth T which increases from a minimum in the direction of rotation of the rotor 9, indicated by the arrow P to a point of maximum radial depth at the opening of the pipe 12. The end wall 17 of the compartment 16 has a projection 18 directed opposite to the direction of rotation of the rotor 9 i.e. directed into the compartment. This projection 18 has an apex radially outside the plane of the surface of the circumferential wall 2.

In operation, when the rotor 9 is rotated with the container 1 filled with a suspension, a rotation of the contents of the container in the direction of the arrow P is first established. Thereafter, a circulating motion of the suspension in the direction of the arrows R in FIG. 1 occurs. Because of these movements, the mass of waste paper further pulped by the rotor 9 is exposed to the action of centrifugal force, whereby a sorting effect is established. Because of the slope of the circumferential wall 2 and the wall section 11, heavy impurities quickly reach the angular zone between the circumferential wall 2 and the end wall 4. These heavy impurities are then held in the compartment 16. The light impurities accumulate in the axis A of the container 1 and can be discharged through the outlet opening 13. Inside the compartment 16, a flow is established as indicated by arrows U and V (FIG. 2) and this effectively prevents any heavy impurities caught in the end region of the compartment 16 from being entrained by the circulatory movement.

Although the stock pulper has been shown with a horizontally extending axis A and the compartment 16 disposed at the lowest point of the container 1, it is understood that other arrangements are conceivable. For example, the axis A can extend obliquely or vertically. With a vertical arrangement, the rotor can for example be at the top.

During operation, the heavier particles move to the outer radial limits of the container 1 and to the region adjacent the juncture of the circumferential wall 2 and end wall 4. Because of the conical shape of the end wall 4 the heavier particles are more positively separated into the outer region of the container 1 while the lighter particles are passed out of the discharge pipe 13.

What is claimed is:

1. A stock pulper for pulping and sorting waste paper comprising a container for receiving a stock suspension, said container being in the form of a body of revolution with a front wall, an end wall and a conical circumferential wall extending from said front wall on an increasing diameter to said end wall;

a screen forming a part of said front wall for discharging stock from said container;

a discharge means in communication with said screen for discharging the stock passed through said screen;

a rotor rotatably mounted within said container adjacent said screen and axially of said container;

a first outlet opening in said end wall axially of said container for removing impurities of low specific gravity from the stock suspension; and a second outlet opening in said circumferential wall adjacent said end wall for removing heavy impurities from the stock suspension.

2. A stock pulper as set forth in claim 1 wherein said end wall is conical and has an apex directed into the interior of said container.

3. A stock pulper as set forth in claim 1 further comprising a compartment within said container extending over a part of the circumference of said circumferential wall and communicating with said second outlet opening, said compartment having a radial depth increasing in the direction of rotation of said rotor to a point of maximum radial depth at said second outlet opening.

4. A stock pulper as set forth in claim 3 wherein a radially extending discharge pipe forms said second outlet opening.

5. A stock pulper as set forth in claim 3 wherein said compartment includes an end wall having a projection directed opposite to said direction of rotation of said rotor, said projection having an apex radially outside the plane of the surface of said circumferential wall.

6. A stock pulper as set forth in claim 3 wherein said container is disposed on a horizontal axis and said compartment is disposed at the lowest point of said container.

7. In a stock pulper for pulping and sorting waste paper having a container for receiving a stock suspension, said container having a conical circumferential wall and an outlet opening in said wall adjacent the larger end thereof for removing impurities; a compartment within said container extending over a part of the circumference of said wall and communicating with said outlet opening, said compartment having a radial depth increasing in a direction towards said outlet opening to a point of maximum depth at said outlet opening, said compartment having an end wall with a projection directed into said compartment, said projection having an apex radially outside the plane of said circumferential wall.

8. In a stock pulper for pulping and sorting waste paper having a container for receiving a stock suspension, said container having a conical circumferential wall, an outlet opening in said wall and an end wall, said walls defining an acute angle therebetween, said end wall being conical with an apex directed into the interior of said container.

* * * * *